US005992095A

United States Patent [19]

Tilley

[11] Patent Number: 5,992,095

[45] Date of Patent: Nov. 30, 1999

[54] SECURITY ENCLOSURE FOR CONVENIENCE STORES AND THE LIKE

[75] Inventor: Kevin L. Tilley, Houston, Tex.

[73] Assignee: Conoco Inc., Ponca City, Okla.

[21] Appl. No.: 08/917,658

[22] Filed: Aug. 25, 1997

[51] Int. Cl.[6] ..... E06B 3/34

[52] U.S. Cl. ..... 49/41; 49/125; 49/372

[58] Field of Search ..... 49/40, 449, 125, 49/126, 127, 130, 323, 372; 312/140.1, 140.2, 140.3, 140.4; 109/6, 7, 10, 11, 12, 13

[56] References Cited

U.S. PATENT DOCUMENTS

| | | | |
|---|---|---|---|
| 416,146 | 11/1889 | Wood | 49/40 |
| 421,350 | 2/1890 | Cook | 49/449 |
| 549,901 | 11/1895 | Davis | 49/40 |
| 636,491 | 11/1899 | Cohen | 49/40 |
| 933,570 | 9/1909 | Ludeman | 49/40 |
| 1,747,655 | 2/1930 | Wright . | |
| 2,201,105 | 5/1940 | Fabriani | 49/449 |
| 2,850,346 | 9/1958 | Holderle et al. | 312/140.4 |
| 3,103,713 | 9/1963 | Ahlgren | 49/449 |
| 3,350,151 | 10/1967 | Phillips | 312/140.4 |
| 4,280,414 | 7/1981 | Allshouse . | |
| 4,545,630 | 10/1985 | Izumi et al. | 49/40 |
| 4,785,579 | 11/1988 | Sugiyama . | |
| 4,991,347 | 2/1991 | Takimoto . | |
| 5,022,454 | 6/1991 | Kobayashi . | |

OTHER PUBLICATIONS

Disclosure of "Retractable Security Enclosures Concept" by Kevin L. Tilley, May 7, 1996.

*Primary Examiner*—Jerry Redman
*Assistant Examiner*—Curtis A. Cohen
*Attorney, Agent, or Firm*—Howson & Howson

[57] ABSTRACT

Curved transparent panels, suspended from a pair of parallel, curved tracks, are deployed in overlapping relationship to one another on top of a curved counter from a storage enclosure in which the panels are in stacked relationship to one another.

9 Claims, 4 Drawing Sheets

SECURITY ENCLOSURE FOR CONVENIENCE STORES AND THE LIKE

SUMMARY OF THE INVENTION

This invention relates to security enclosures, and more specifically to a security enclosure for the protection of convenience store personnel from robbery.

Convenience stores, by their nature, need to be open to the public late at night. Especially during late hours, when customers enter the store infrequently, it is often impractical to have more than one clerk in attendance. These stores are also often at isolated locations. For these and other reasons, despite the use of vaults to limit the amount of cash on in the register, convenience stores have become a favorite target of robbers, who threaten violence, and often do violence, to the convenience store personnel.

It is also desirable in a convenience store to provide as much counter space as possible in order to allow two or more clerks to work simultaneously during peak hours, and to provide room for countertop displays and for customers to lay down their purchases. The requirement for enhanced counter space has led to the use of island type check-out counters and other forms of counters that extend at least partway around the convenience store clerk, including counters having two or more parts meeting one another at an angle, and curved counters. Until now, there has been no practical way to protect convenience store workers behind such counters.

Heretofore, conventional security enclosures, in the form of retractable screens and the like, have required a structure which is both visible and obtrusive even when the screens are in their retracted condition during daylight hours. The typical security enclosure structure, even when open during daylight hours, not only limits the available counter space, but also conveys to the customers a subtle message that they are in an insecure environment.

An object of this invention, therefore, is to provide a simple and practical enclosure system for the protection of convenience store personnel located behind a curved check-out counter. It is also an object of the invention to provide a security enclosure which interferes only minimally with available counter space, and which is inconspicuous when it is not in use.

The invention addresses the problem of protection of workers behind large counters by means of a curved counter structure having above it a set of curved transparent panels that can be deployed in overlapping relationship to one another on top of the counter from a stowed position in which the panels are in stacked relationship to one another.

A preferred security enclosure in accordance with the invention, comprises a counter, a partition, extending from one location on the counter to another separate location on the counter. The partition and counter together delimit a space in which one or more authorized persons, e.g. convenience store check-out clerks, work. A retractable closure comprises a plurality of transparent panels, each having an arcuate curvature in horizontal cross-section. The panels are stowable in face to face relationship within one or more storage enclosures and are mounted on a guide for movement from the stowed condition to a deployed condition in which they are positioned above the counter and in overlapping relationship to one another. When deployed, the panels constitute an arcuate barrier, extending from said one location on the counter to said separate location on the counter, and prevent access to the authorized personnel space.

In a preferred embodiment of the invention, the guide comprises a pair of parallel, arcuate tracks, each having at least one of the panels suspended from it. Each track has the same curvature as that of all of the panels mounted on it. Panel storage enclosures are preferably provided adjacent to both ends of the counter so that, in the case of a barrier made up of four panels for example, two panels can be stowed in each of the two storage enclosures. A merchandise support, e.g. a cigarette merchandiser, can be located at least in part within a panel storage space, in such a way that it extends through an imaginary, plane defined by the vertical edges of a stowed panel. The guide also preferably comprises means, attached to the counter, for engaging the inner and outer faces of the panels adjacent to their lower edges. A vertically retractable bolt in each panel cooperates with one of a plurality of bolt-receiving strikes in the counter to lock the panel in place in the deployed condition. Each bolt has a manually operable tab, preferably located at least in part within a recess on the inner face of its panel.

The invention provides a simple, practical and effective security enclosure which allows maximum use of counter space, and which can be easily deployed for use during evening hours, and conveniently stowed in an inconspicuous location during daylight hours.

Other objects, details and advantages of the invention will be apparent from the following detailed description when read in conjunction with the drawings.

DETAILED DESCRIPTION

Figure 1:
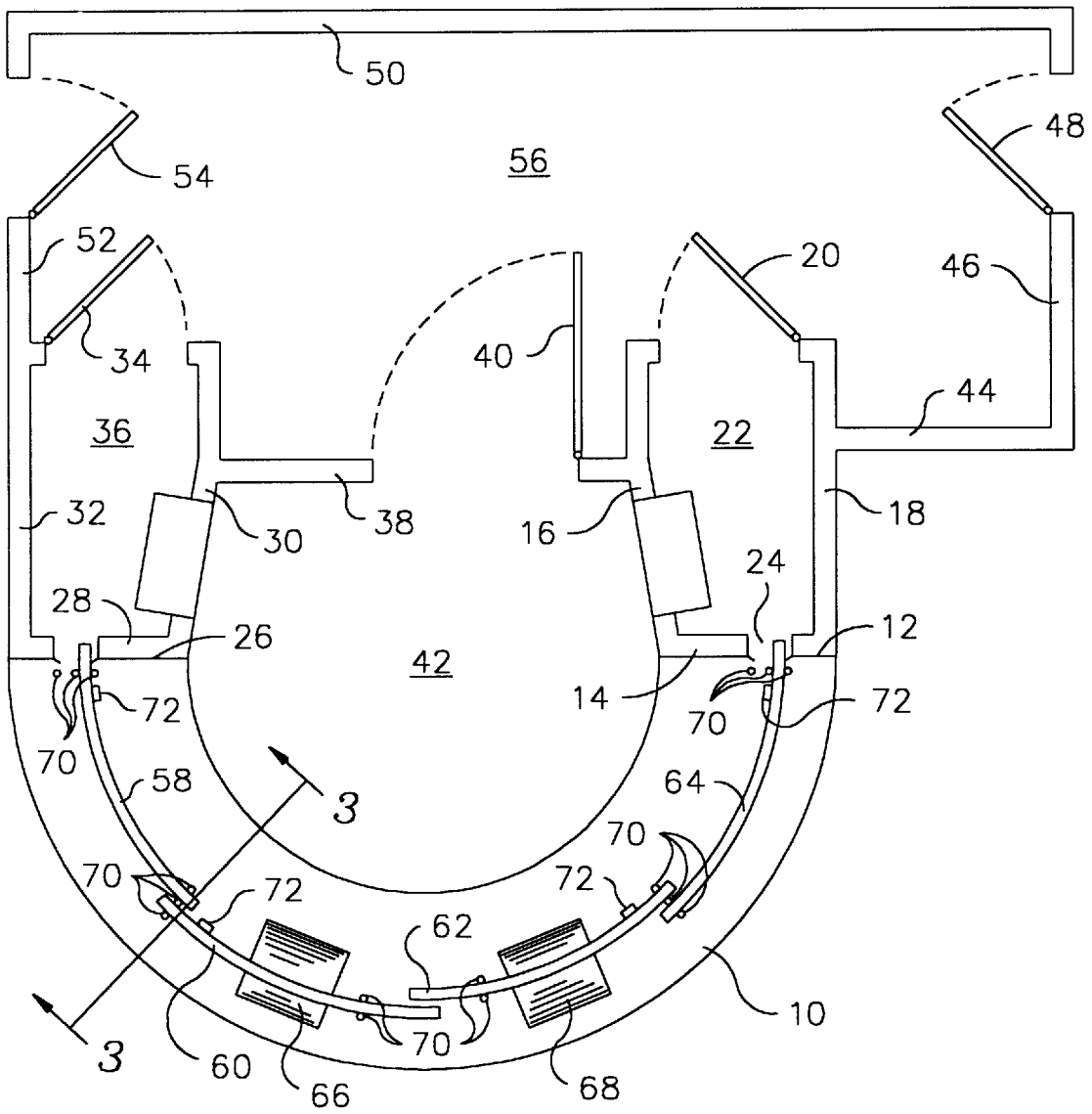
FIG. 1 is a top plan view showing the layout of a typical security enclosure in accordance with the invention with the panels deployed.

The security enclosure is shown as a preferred embodiment in FIG. 1, which comprises a counter 10 situated within a convenience store. The counter is preferably arcuate in shape. It is typically three feet high, and comprises a countertop with storage compartments (not shown) underneath it on the concave side and merchandise display racks (not shown) built into it on the convex side. The structure underneath the countertop, whatever it may be, provides a barrier, extending substantially from the floor up to the countertop level.

One end 12 of the counter meets a wall 14, and, with walls 16 and 18 and door 20, forms an enclosure providing a panel storage space 22. Wall 14 has an opening 24 at a location between walls 16 and 18. The opposite end 26 of the counter meets a wall 28 of a similar enclosure comprising walls 30 and 32 and door 34, defining a second panel storage space 36. Optionally, a wall 38, having a door 40 extends from wall 16 to wall 30. Thus, walls 14, 16, 28, 30 and 38, together with door 40, constitute a partition. This partition and the counter together delimit an authorized personnel space 42.

In the embodiment shown in FIG. 1, a wall 44, a wall 46 with a door 48, a rear wall 50 and an extension 52 of wall 32, with a door 54, together form a second partition preventing customer access to a back room 56. If door 40 is left open, an alternative authorized personnel space, comprising spaces 42 and 56 together, is delimited by the counter and walls 18, 44, 46, 50, and 32.

All of the walls in FIG. 1 preferably extend from floor to ceiling. The space above the counter, extending from the countertop to the ceiling, is closed off by a series of transparent arcuate panels 58, 60, 62 and 64, which extend, in overlapping relationship to one another, from wall 14 at end 12 of the counter to wall 28 at the opposite end 26 of the counter. The panels are preferably acrylic sheets about 1 inch thick, each having a constant, simple, arcuate curvature about a vertical axis. Panels 60 and 64 have a slightly greater radius of curvature than that of panels 58 and 62, so that the faces of the panels are parallel when they are stacked in face-to-face relationship. Preferably the panels are coated with an impact-resistant film.

Stainless steel deal trays 66 and 68, located in recesses in the countertop, allow cash, credit cards, receipts, etc. to be passed between customer and clerk underneath the panels.

Guide rollers 70 are provided on the countertop to engage the inner and outer faces of the panels near their lower edges. Strikes 72 are also provided in the countertop to receive locking bolts (not shown in FIG. 1) built into the panels. Details of the guide rollers 70, the strikes 72 and the locking bolts will be described with reference to FIGS. 3 and 4.

Figure 2:
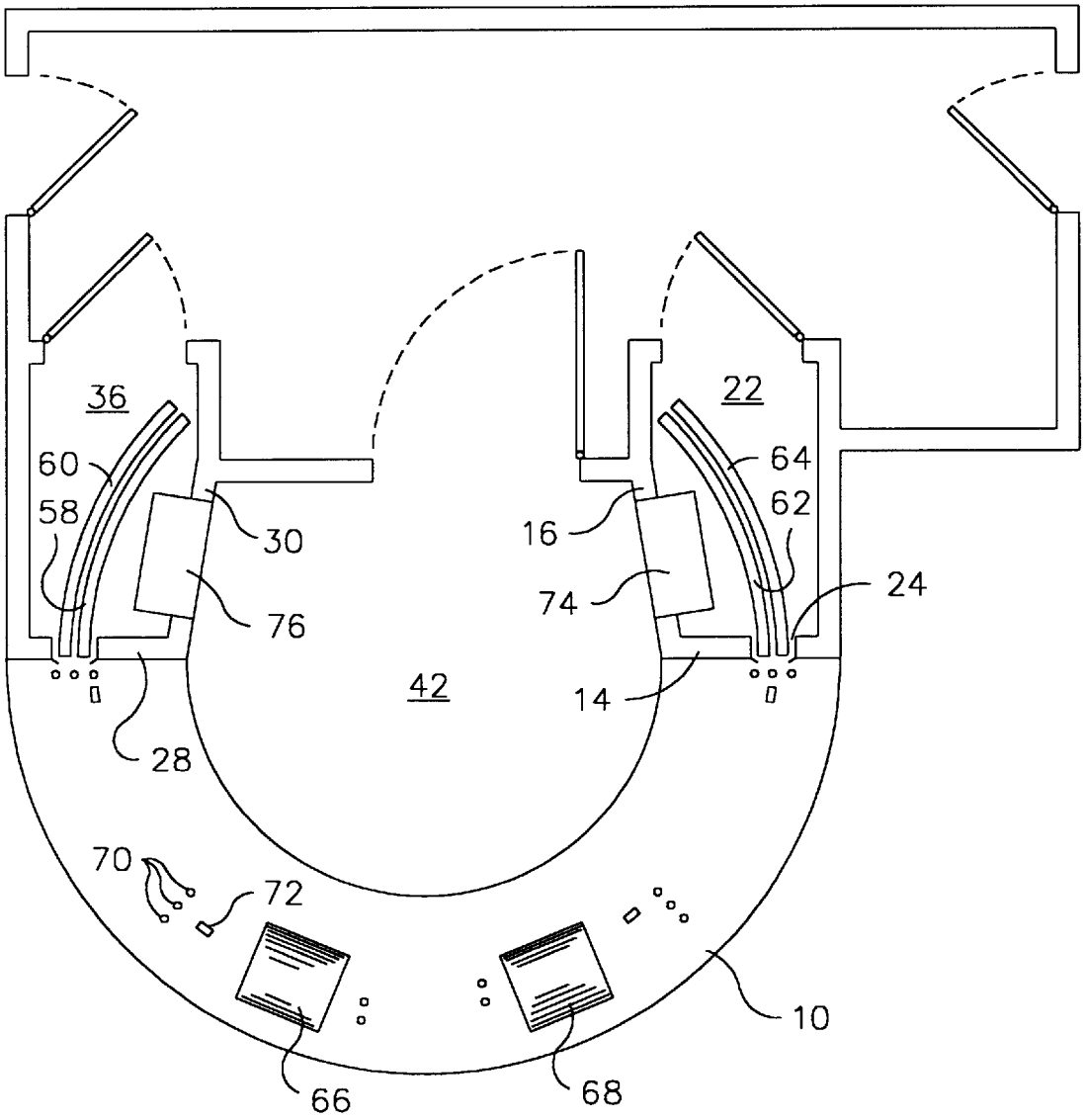
FIG. 2 is a top plan view, similar to FIG. 1, but showing the panels stowed.

The panels are stowed in spaces 22 and 36 as shown in FIG. 2. Panels 64 and 68 are in face-to-face relationship within space 22, and panels 58 and 60 are in face-to-face relationship within space 36. When stowed, the panels are essentially invisible to customers. At most, the edges of the panels are visible through opening 24 in wall 14, and through the corresponding opening in wall 28. Optionally, flexible baffles, or doors, can be provided to close the openings in walls 14 and 28 either partially or completely, in order to hide the baffles.

While spaces 22 and 36 could be shaped to conform to the curvature of the panels, it is more convenient to make them generally polygonal as shown, since the space not occupied by the stowed panels can be used for storage. For example, supplies can be stored underneath the panels below counter level. Furthermore, for efficient use of space, article supports such as cigarette merchandisers 74 and 76 can be mounted in walls 74 and 76 without interfering with the panels. As shown in FIG. 2, cigarette merchandiser 74 extends past imaginary plane 78 defined by vertical edges of panels 62, so that it is located in part within the concavity of panel 62.

Figure 3:
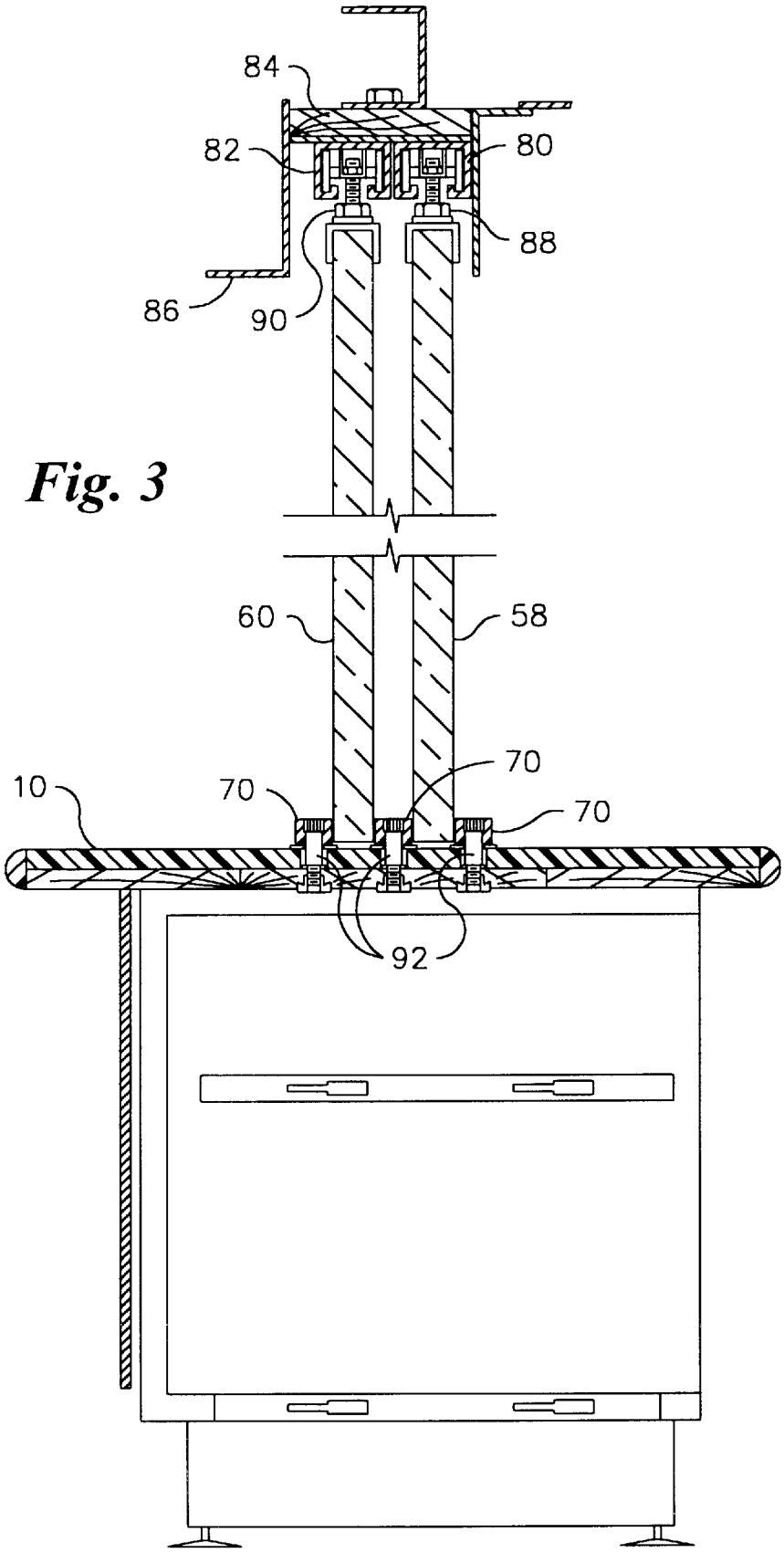
FIG. 3 is a vertical section taken on plane 3—3 of FIG. 1.

As shown in FIG. 3, panels 58 and 60 are supported from overhead, channel-shaped, tracks 80 and 82, mounted to a beam 84 behind a soffit 86. Trolleys 88 and 90 roll on the inturned flanges of the tracks, and are secured to the upper edges of the panels. The tracks extend in parallel arcs across the ceiling above the counter and into both storage spaces 22 and 36, so that they are able to guide the panels for movement from their stowed condition as shown in FIG. 2 to their deployed condition as shown in FIG. 1. The faces of the panels, adjacent to their lower edges are engaged by the guide rollers 70, which are rotatable on vertical posts 92 mounted in the countertop.

The panels are spaced somewhat from each other, as shown in FIG. 3, typically by a distance of about an inch or less. In their deployed condition, the panels overlap one another as shown in FIG. 1 by a distance such that a weapon cannot be inserted between the edges of the panels and aimed effectively.

Figure 4:
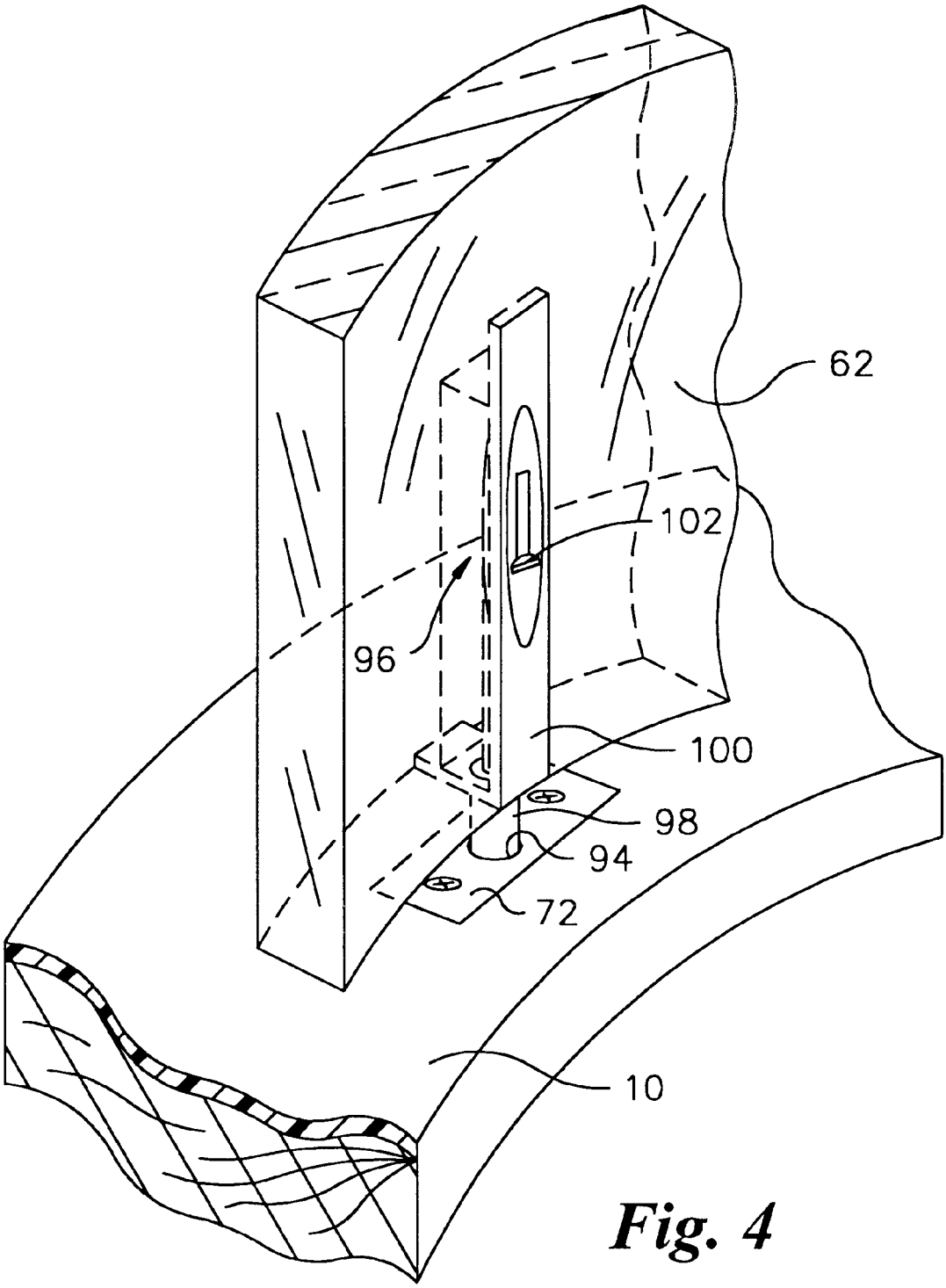
FIG. 4 is a fragmentary perspective view showing details of a panel latching device for securing a deployed panel to a counter.

As shown in FIG. 4, a metal strike 72, having a bolt-receiving hole 94 is secured to countertop 10, and panel 62 has built into it a bolt assembly 96 comprising a vertically retractable bolt 98 in a frame 100, with a recessed operating tab 102 extending laterally from the bolt on the concave side of the panel 62. The bolt assembly 96 is mounted in a recess formed in the concave face of panel 62.

When the panels are deployed, the clerk, in space 42, is protected by the enclosure consisting of the counter, the panels, and the wall structure which extends from one end of the counter to the other. Cash and receipts are passed underneath the panels through deal trays 66 and 68.

A single clerk can readily deploy and stow the panels manually, Alternatively, a motor-driven overhead chain (not shown) can be used to move the panels. Various other modifications can be made to the security enclosure. For example, whereas the counter shown in the drawings is semicircular, the counter can subtend angles either smaller or greater than 180°. Moreover, the number and arrangement of the panels can be varied, and it is possible to stow all of the panels in a single storage enclosure at one end of the counter, or in one or more storage enclosures located between separate counter segments.

Still other modifications may be made to the apparatus and method described above without departing from the scope of the invention as defined in the following claims.

I claim:

1. A security enclosure for retail stores comprising:

a counter having a first end and a second end;

a first partition engaging said first end of the counter and extending from said first end of the counter to said second end of the counter, the first partition and counter together delimiting an authorized personnel space;

a plurality of transparent panels, each having an arcuate curvature in horizontal cross-section;

panel storage means comprising at least one panel storage enclosure, defined by the first partition and a second partition, for storing a plurality of the panels in face to face relationship in a stowed condition within the enclosure, said at least one panel storage enclosure being located adjacent to and separate from, said first end of the counter, said first and second partitions defining an access opening for passage of panels into and out of said at least one panel storage enclosure; and a guide means for mounting the panels for horizontal movement from the stowed condition to a deployed condition in which the panels are positioned above the counter and in overlapping relationship to one another whereby the panels constitute an arcuate barrier extending from said first end of the counter to said second end of the counter;

the first partition and the panels, when said panels are in said deployed condition, preventing access to the authorized personnel space.

2. A security enclosure according to claim 1, in which the guide means comprises a pair of parallel, arcuate tracks, each having at least one of the panels mounted thereon, each track, and all of the panels mounted thereon having the same curvature in horizontal cross-section.

3. A security enclosure according to claim 1, in which the guide means comprises a pair of tracks located above the panels, and in which each panel is suspended from one of the tracks.

4. A security enclosure according to claim 1, in which the panel storage means comprises a second panel storage enclosure, defined by the first partition and a third partition, for storing a plurality of the panels, in face to face relationship in a stowed condition within the second panel storage enclosure, the second panel storage enclosure being located adjacent to said second end of the counter.

5. A security enclosure according to claim 1 in which each of said panels has two opposite vertical edges, in which the guide means is positioned to support at least two of the panels within said at least one panel storage enclosure, and including merchandise-supporting means located at least in part within said at least one panel storage enclosure, and extending through an imaginary plane defined by the opposite vertical edges of one of said two panels.

6. A security enclosure according to claim 1, in which each of said panels has two opposite vertical edges, in which the guide means is positioned to support at least two of the panels within said at least one panel storage enclosure, and including merchandise-supporting means, accessible from said authorized personnel space, and located at least in part within said at least one panel storage enclosure, and extending through an imaginary plane defined by the opposite vertical edges of one of said two panels.

7. A security enclosure according to claim 1, in which each of the panels has an inner surface facing toward the authorized personnel space, an outer surface facing away from the authorized personnel space, and a lower edge in close proximity to the counter when in the deployed condition, and in which the guide means comprises means, attached to the counter, for engaging the inner and outer faces of the panels adjacent to their lower edges.

8. A security enclosure according to claim 1, in which each of the panels has an inner surface facing toward the authorized personnel space, an outer surface facing away from the authorized personnel space, and a lower edge in close proximity to the counter when in the deployed condition, and including locking means for securing each panel in fixed relationship to the counter when the panels are in the deployed condition, the locking means comprising a vertically retractable bolt in each panel, and a plurality of bolt-receiving strikes in the counter, the retractable bolt in each panel having a manually engageable tab, extending laterally therefrom and accessible from the authorized personnel space, for moving the bolt into and out of a bolt-receiving strike.

9. A security enclosure according to claim 1, in which each of the panels has an inner surface facing toward the authorized personnel space, an outer surface facing away from the authorized personnel space, and a lower edge in close proximity to the counter when in the deployed condition, and including locking means for securing each panel in fixed relationship to the counter when the panels are in the deployed condition, the locking means comprising a recess on the inner surface of each panel, a vertically retractable bolt in each panel, and a plurality of bolt-receiving strikes in the counter, the retractable bolt in each panel having a manually engageable tab, extending laterally therefrom, located at least in part within said recess, and accessible from the authorized personnel space, for moving the bolt into and out of a bolt-receiving strike.

* * * * *